US006942316B2

(12) United States Patent
Scheffelin et al.

(10) Patent No.: US 6,942,316 B2
(45) Date of Patent: Sep. 13, 2005

(54) FLUID DELIVERY FOR PRINTHEAD ASSEMBLY

(75) Inventors: Joseph E Scheffelin, Poway, CA (US); Ronald Ender, Corvallis, OR (US); Paul Mark Haines, Lebanon, OR (US); Gary G. Lutnesky, Corvallis, OR (US); Norman E Pawlowski, Jr., Corvallis, OR (US); Rhonda L. Wilson, Monmouth, OR (US); John M. Herrmann, Corvallis, OR (US); Kevin E Swier, Albany, OR (US); Gary Tarver, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 40 days.

(21) Appl. No.: 10/283,468

(22) Filed: Oct. 30, 2002

(65) Prior Publication Data

US 2004/0085393 A1 May 6, 2004

(51) Int. Cl.[7] ..... B41J 2/155
(52) U.S. Cl. ..... 347/42; 347/66
(58) Field of Search ..... 347/42, 13, 65, 347/66, 84, 12, 40, 50

(56) References Cited

U.S. PATENT DOCUMENTS

| | | | | |
|---|---|---|---|---|
| 5,016,023 A | | 5/1991 | Chan et al. | |
| 5,057,854 A | | 10/1991 | Pond et al. | |
| 5,079,189 A | | 1/1992 | Drake et al. | |
| 5,098,503 A | | 3/1992 | Drake | |
| 5,160,945 A | | 11/1992 | Drake | |
| 5,469,199 A | | 11/1995 | Allen et al. | |
| 5,489,930 A | | 2/1996 | Anderson | |
| 5,565,900 A | | 10/1996 | Cowger et al. | |
| 5,696,544 A | | 12/1997 | Komuro | |
| 5,742,305 A | | 4/1998 | Hackleman | |
| 5,796,416 A | * | 8/1998 | Silverbrook | 347/47 |
| 5,939,206 A | | 8/1999 | Kneezel et al. | |
| 6,123,410 A | | 9/2000 | Beerling et al. | |
| 6,250,738 B1 | | 6/2001 | Waller et al. | |
| 6,322,206 B1 | | 11/2001 | Boyd et al. | |
| 6,341,845 B1 | | 1/2002 | Scheffelin et al. | |
| 6,343,857 B1 | | 2/2002 | Cowger | |
| 6,428,145 B1 | | 8/2002 | Barbour | |
| 6,431,683 B1 | | 8/2002 | Ho et al. | |
| 6,435,653 B1 | | 8/2002 | Boyd et al. | |
| 2002/0033861 A1 | | 3/2002 | Boyd | |

OTHER PUBLICATIONS

Ross R. Allen, "Inkjet Printing with Large Pagewide Arrays: Issues and Challenges", Recent Progress in Ink Jet Technologies II, pp. 114–120; originally published in "12th International Congress on Advances in Non–Impact Printing Technologies Proc.", p. 43, 1996.

* cited by examiner

*Primary Examiner*—Lamson Nguyen

(57) ABSTRACT

A printhead assembly includes a carrier having a fluid manifold defined therein, a plurality of printhead dies each mounted on the carrier and communicating with the fluid manifold, and a fluid delivery assembly coupled with the carrier and communicating with the fluid manifold.

30 Claims, 6 Drawing Sheets

FLUID DELIVERY FOR PRINTHEAD ASSEMBLY

THE FIELD OF THE INVENTION

The present invention relates generally to inkjet printheads, and more particularly to fluid delivery for an inkjet printhead assembly.

BACKGROUND OF THE INVENTION

A conventional inkjet printing system includes a printhead, an ink supply which supplies liquid ink to the printhead, and an electronic controller which controls the printhead. The printhead ejects ink drops through a plurality of orifices or nozzles and toward a print medium, such as a sheet of paper, so as to print onto the print medium. Typically, the orifices are arranged in one or more arrays such that properly sequenced ejection of ink from the orifices causes characters or other images to be printed upon the print medium as the printhead and the print medium are moved relative to each other.

In one arrangement, commonly referred to as a wide-array inkjet printing system, a plurality of individual printheads, also referred to as printhead dies, are mounted on a single carrier. As such, a number of nozzles and, therefore, an overall number of ink drops which can be ejected per second is increased. Since the overall number of ink drops which can be ejected per second is increased, printing speed can be increased with the wide-array inkjet printing system.

When mounting a plurality of printhead dies on a single carrier, the single carrier performs several functions including fluid and electrical routing as well as printhead die support. More specifically, the single carrier accommodates communication of ink between the ink supply and each of the printhead dies, accommodates communication of electrical signals between the electronic controller and each of the printhead dies, and provides a stable support for each of the printhead dies. As such, ink from the ink supply is supplied to each of the printhead dies.

Accordingly, it is desirable for an assembly which accommodates delivery of ink from the ink supply to each of the printhead dies.

SUMMARY OF THE INVENTION

A printhead assembly includes a carrier having a fluid manifold defined therein, a plurality of printhead dies each mounted on the carrier and communicating with the fluid manifold, and a fluid delivery assembly coupled with the carrier and communicating with the fluid manifold.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
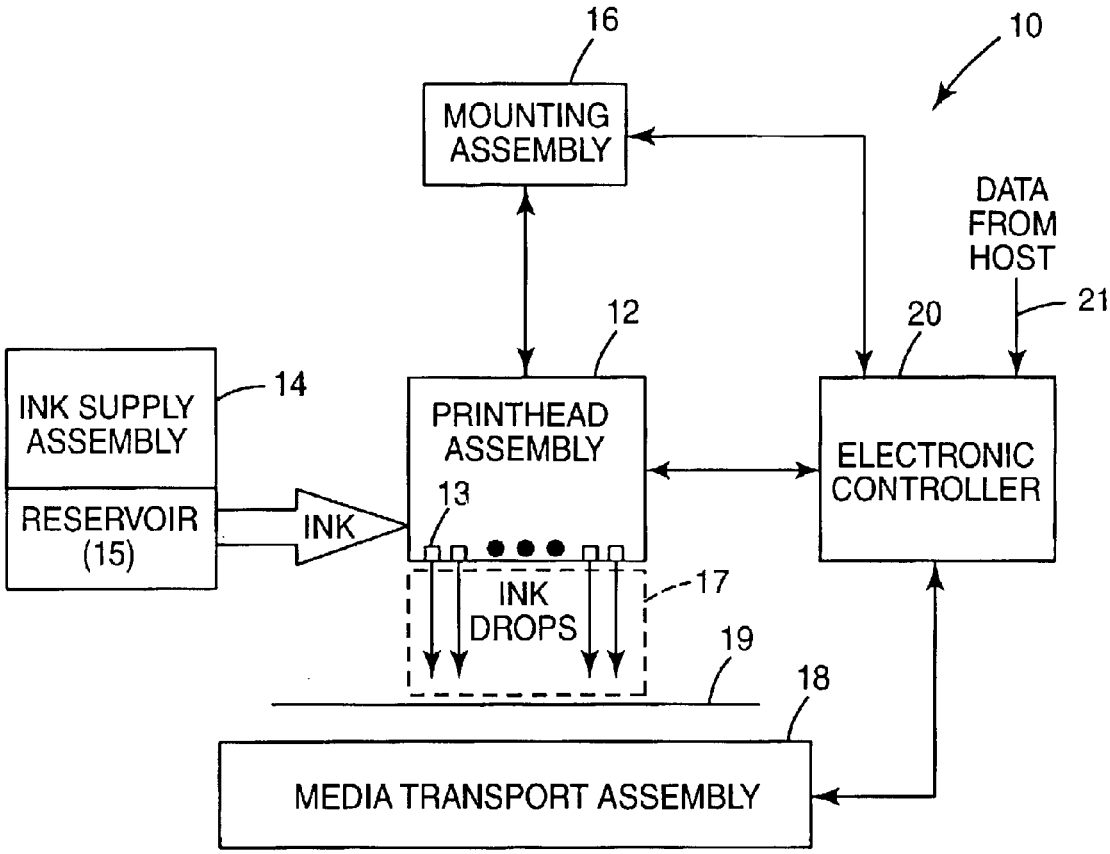
FIG. 1 is a block diagram illustrating one embodiment of an inkjet printing system.

FIG. 1 illustrates one embodiment of an inkjet printing system 10. Inkjet printing system 10 includes an inkjet printhead assembly 12, an ink supply assembly 14, a mounting assembly 16, a media transport assembly 18, and an electronic controller 20. Inkjet printhead assembly 12 is formed according to an embodiment of the present invention, and includes one or more printheads which eject drops of ink or fluid through a plurality of orifices or nozzles 13.

In one embodiment, the drops of ink are directed toward a medium, such as print medium 19, so as to print onto print medium 19. Print medium 19 includes any type of suitable sheet material, such as paper, card stock, transparencies, Mylar, and the like. Typically, nozzles 13 are arranged in one or more columns or arrays such that properly sequenced ejection of ink from nozzles 13 causes, in one embodiment, characters, symbols, and/or other graphics or images to be printed upon print medium 19 as inkjet printhead assembly 12 and print medium 19 are moved relative to each other.

Ink supply assembly 14 supplies ink to inkjet printhead assembly 12 and includes a reservoir 15 for storing ink. As such, in one embodiment, ink flows from reservoir 15 to inkjet printhead assembly 12. In one embodiment, inkjet printhead assembly 12 and ink supply assembly 14 are housed together in an inkjet cartridge or pen. In another embodiment, ink supply assembly 14 is separate from inkjet printhead assembly 12 and supplies ink to inkjet printhead assembly 12 through an interface connection, such as a supply tube.

Mounting assembly 16 positions inkjet printhead assembly 12 relative to media transport assembly 18 and media transport assembly 18 positions print medium 19 relative to inkjet printhead assembly 12. Thus, a print zone 17 is defined adjacent to nozzles 13 in an area between inkjet printhead assembly 12 and print medium 19. In one embodiment, inkjet printhead assembly 12 is a scanning type printhead assembly and mounting assembly 16 includes a carriage for moving inkjet printhead assembly 12 relative to media transport assembly 18. In another embodiment, inkjet printhead assembly 12 is a non-scanning type printhead assembly and mounting assembly 16 fixes inkjet printhead assembly 12 at a prescribed position relative to media transport assembly 18.

Electronic controller 20 communicates with inkjet printhead assembly 12, mounting assembly 16, and media transport assembly 18. Electronic controller 20 receives data 21 from a host system, such as a computer, and includes memory for temporarily storing data 21. Typically, data 21 is sent to inkjet printing system 10 along an electronic, infrared, optical or other information transfer path. Data 21 represents, for example, a document and/or file to be printed. As such, data 21 forms a print job for inkjet printing system 10 and includes one or more print job commands and/or command parameters.

In one embodiment, electronic controller 20 provides control of inkjet printhead assembly 12 including timing control for ejection of ink drops from nozzles 13. As such, electronic controller 20 defines a pattern of ejected ink drops which form characters, symbols, and/or other graphics or images on print medium 19. Timing control and, therefore, the pattern of ejected ink drops is determined by the print job commands and/or command parameters. In one embodiment, logic and drive circuitry forming a portion of electronic controller 20 is located on inkjet printhead assembly 12. In another embodiment, logic and drive circuitry is located off inkjet printhead assembly 12.

Figure 2:
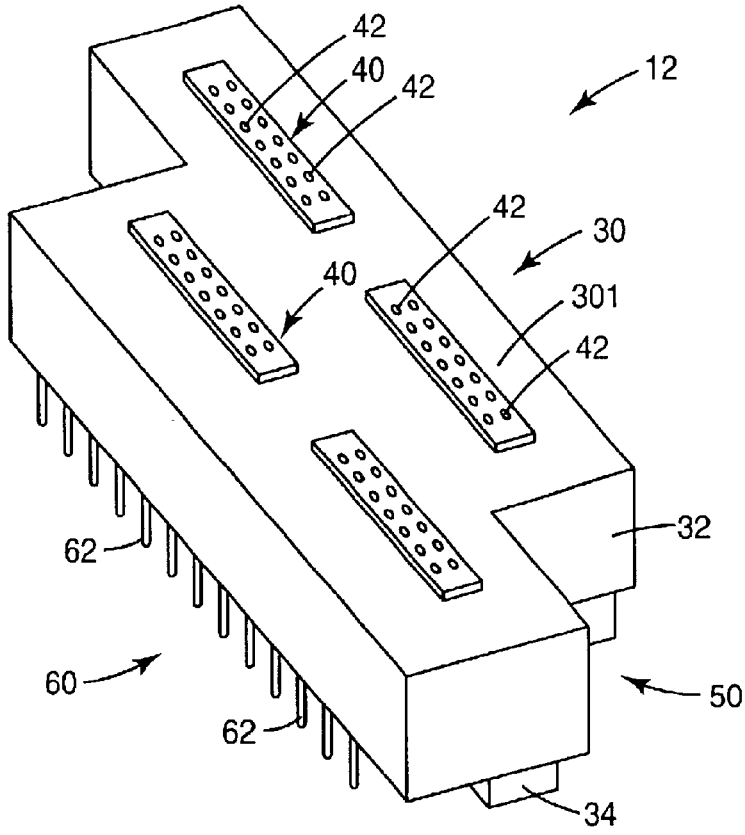
FIG. 2 is a top perspective view illustrating one embodiment of an inkjet printhead assembly.
Figure 3:
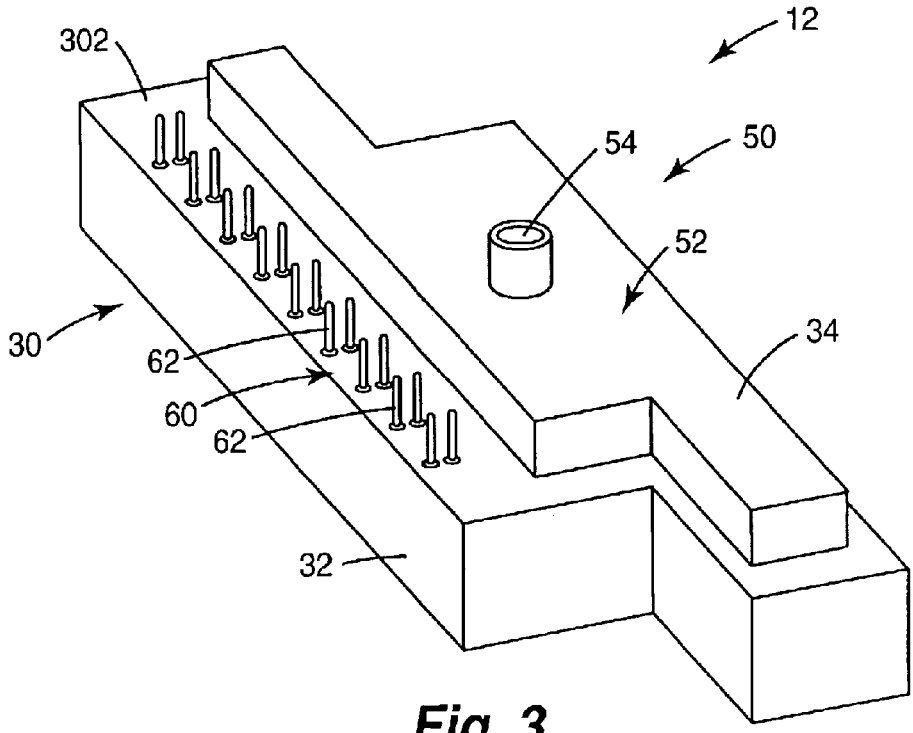
FIG. 3 is a bottom perspective view of the inkjet printhead assembly of FIG. 2.

FIGS. 2 and 3 illustrate one embodiment of a portion of inkjet printhead assembly 12. Inkjet printhead assembly 12 is a wide-array or multi-head printhead assembly and includes a carrier 30, a plurality of printhead dies 40, an ink delivery system 50, and an electronic interface system 60. Carrier 30 has an exposed surface or first face 301 and an exposed surface or second face 302 which is opposite of and oriented substantially parallel with first face 301. Carrier 30 serves to carry or provide mechanical support for printhead dies 40. In addition, carrier 30 accommodates fluidic communication between ink supply assembly 14 and printhead dies 40 via ink delivery system 50 and accommodates electrical communication between electronic controller 20 and printhead dies 40 via electronic interface system 60.

Printhead dies 40 are mounted on first face 301 of carrier 30 and aligned in one or more rows. In one embodiment, printhead dies 40 are spaced apart and staggered such that printhead dies 40 in one row overlap at least one printhead die 40 in another row. Thus, inkjet printhead assembly 12 may span a nominal page width or a width shorter or longer than nominal page width. While four printhead dies 40 are illustrated as being mounted on carrier 30, the number of printhead dies 40 mounted on carrier 30 may vary.

In one embodiment, a plurality of inkjet printhead assemblies 12 are mounted in an end-to-end manner. In one embodiment, to provide for at least one printhead die 40 of one inkjet printhead assembly 12 overlapping at least one printhead die 40 of an adjacent inkjet printhead assembly 12, carrier 30 has a staggered or stair-step profile. While carrier 30 is illustrated as having a stair-step profile, it is within the scope of the present invention for carrier 30 to have other profiles including a substantially rectangular profile.

Ink delivery system 50 fluidically couples ink supply assembly 14 with printhead dies 40. In one embodiment, ink delivery system 50 includes a fluid manifold 52 and a port 54. Fluid manifold 52 is formed in carrier 30 and distributes ink through carrier 30 to each printhead die 40. Port 54 communicates with fluid manifold 52 and provides an inlet for ink supplied by ink supply assembly 14.

Electronic interface system 60 electrically couples electronic controller 20 with printhead dies 40. In one embodiment, electronic interface system 60 includes a plurality of electrical contacts 62 which form input/output (I/O) contacts for electronic interface system 60. As such, electrical contacts 62 provide points for communicating electrical signals between electronic controller 20 and inkjet printhead assembly 12. Examples of electrical contacts 62 include I/O pins which engage corresponding I/O receptacles electrically coupled to electronic controller 20 and I/O contact pads or fingers which mechanically or inductively contact corresponding electrical nodes electrically coupled to electronic controller 20. Although electrical contacts 62 are illustrated as being provided on second face 302 of carrier 30, it is within the scope of the present invention for electrical contacts 62 to be provided on other sides of carrier 30.

Figure 4:
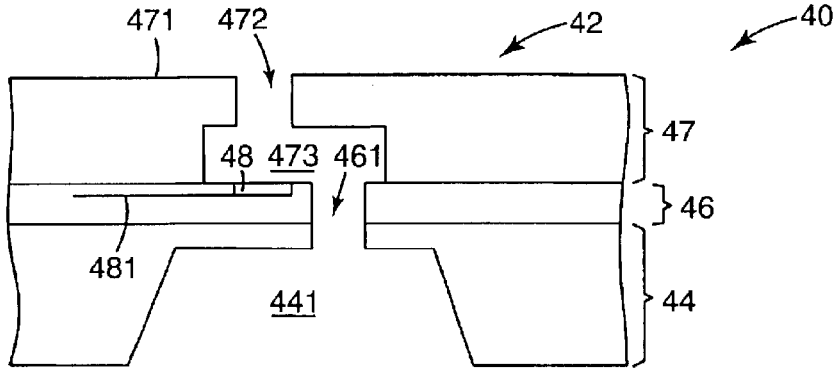
FIG. 4 is a schematic cross-sectional view illustrating portions of one embodiment of a printhead die.

As illustrated in the embodiment of FIGS. 2 and 4, each printhead die 40 includes an array of drop ejecting elements 42. Drop ejecting elements 42 are formed on a substrate 44 which has an ink or fluid feed slot 441 formed therein. As such, fluid feed slot 441 provides a supply of ink or fluid to drop ejecting elements 42. Substrate 44 is formed, for example, of silicon, glass, or a stable polymer.

In one embodiment, each drop ejecting element 42 includes a thin-film structure 46 and an orifice layer 47. Thin-film structure 46 includes a firing resistor 48 and has an ink or fluid feed channel 461 formed therein which communicates with fluid feed slot 441 of substrate 44. Orifice layer 47 has a front face 471 and a nozzle opening 472 formed in front face 471. Orifice layer 47 also has a nozzle chamber 473 formed therein which communicates with nozzle opening 472 and fluid feed channel 461 of thin-film structure 46. Firing resistor 48 is positioned within nozzle chamber 473 and includes leads 481 which electrically couple firing resistor 48 to a drive signal and ground.

Thin-film structure 46 is formed, for example, by one or more passivation or insulation layers of silicon dioxide, silicon carbide, silicon nitride, tantalum, poly-silicon glass, or other suitable material. In one embodiment, thin-film structure 46 also includes a conductive layer which defines firing resistor 48 and leads 481. The conductive layer is formed, for example, by aluminum, gold, tantalum, tantalum-aluminum, or other metal or metal alloy.

In one embodiment, during operation, ink or fluid flows from fluid feed slot 441 to nozzle chamber 473 via fluid feed channel 461. Nozzle opening 472 is operatively associated with firing resistor 48 such that droplets of ink or fluid are ejected from nozzle chamber 473 through nozzle opening 472 (e.g., normal to the plane of firing resistor 48) and toward a medium upon energization of firing resistor 48.

Example embodiments of printhead dies 40 include a thermal printhead, as described above, a piezoelectric printhead, a flex-tensional printhead, or any other type of fluid ejection device known in the art. In one embodiment, printhead dies 40 are fully integrated thermal inkjet printheads.

Figure 5:
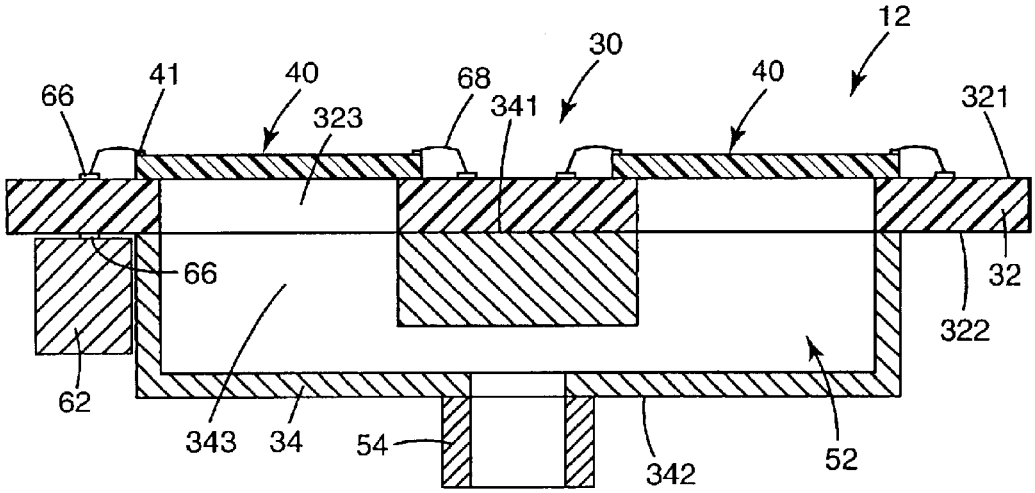
FIG. 5 is a schematic cross-sectional view illustrating one embodiment of an inkjet printhead assembly.

Referring to the embodiment of FIGS. 2, 3, and 5, carrier 30 includes a substrate 32 and a substructure 34. Substrate 32 and substructure 34 provide and/or accommodate mechanical, electrical, and fluidic functions of inkjet printhead assembly 12. More specifically, substrate 32 provides mechanical support for printhead dies 40, accommodates fluidic communication between ink supply assembly 14 and printhead dies 40 via ink delivery system 50, and provides electrical connection between and among printhead dies 40 and electronic controller 20 via electronic interface system 60. Substructure 34 provides mechanical support for substrate 32, accommodates fluidic communication between ink supply assembly 14 and printhead dies 40 via ink delivery system 50, and accommodates electrical connection between printhead dies 40 and electronic controller 20 via electronic interface system 60.

Substrate 32 has a first side 321 and a second side 322 which is opposite first side 321, and substructure 34 has a first side 341 and a second side 342 which is opposite first side 341. In one embodiment, printhead dies 40 are mounted on first side 321 of substrate 32 and substructure 34 is disposed on second side 322 of substrate 32. As such, first side 341 of substructure 34 contacts and is joined to second side 322 of substrate 32.

For transferring ink between ink supply assembly 14 and printhead dies 40, substrate 32 and substructure 34 each have a plurality of ink or fluid passages 323 and 343, respectively, formed therein. Fluid passages 323 extend through substrate 32 and provide a through-channel or through-opening for delivery of ink to printhead dies 40 and, more specifically, fluid feed slot 441 of substrate 44 (FIG. 4). Fluid passages 343 extend through substructure 34 and provide a through-channel or through-opening for delivery of ink to fluid passages 323 of substrate 32. As such, fluid passages 323 and 343 form a portion of ink delivery system 50. Although only one fluid passage 323 is shown for a given printhead die 40, there may be additional fluid passages to the same printhead die, for example, to provide ink of respective differing colors.

In one embodiment, substructure 34 is formed of a non-ceramic material such as plastic. Substructure 34 is formed, for example, of a high performance plastic including a fiber reinforced resin such as polyphenylene sulfide (PPS) or a polystyrene (PS) modified polyphenylene oxide (PPO) or polyphenylene ether (PPE) blend such as NORYL®. It is, however, within the scope of the present invention for substructure 34 to be formed of silicon, stainless steel, or other suitable material or combination of materials. Preferably, substructure 34 is chemically compatible with liquid ink so as to accommodate fluidic routing.

Figure 6:
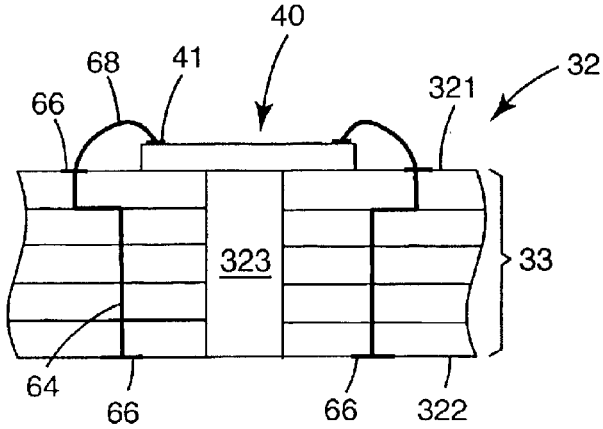
FIG. 6 is a schematic cross-sectional view illustrating one embodiment of a portion of a substrate for an inkjet printhead assembly.

For transferring electrical signals between electronic controller 20 and printhead dies 40, electronic interface system 60 includes a plurality of conductive paths 64 extending through substrate 32, as illustrated in FIG. 6. More specifically, substrate 32 includes conductive paths 64 which pass through and terminate at exposed surfaces of substrate 32. In one embodiment, conductive paths 64 include electrical contact pads 66 at terminal ends thereof which form, for example, I/O bond pads on substrate 32. Conductive paths 64, therefore, terminate at and provide electrical coupling between electrical contact pads 66.

Electrical contact pads 66 provide points for electrical connection to substrate 32 and, more specifically, conductive paths 64. Electrical connection is established, for example, via electrical connectors or contacts 62, such as I/O pins or spring fingers, wire bonds, electrical nodes, and/or other suitable electrical connectors. In one embodiment, printhead dies 40 include electrical contacts 41 which form I/O bond pads. As such, electronic interface system 60 includes electrical connectors, for example, wire bond leads 68, which electrically couple electrical contact pads 66 with electrical contacts 41 of printhead dies 40.

Conductive paths 64 transfer electrical signals between electronic controller 20 and printhead dies 40. More specifically, conductive paths 64 define transfer paths for power, ground, and data among and/or between printhead dies 40 and electrical controller 20. In one embodiment, data includes print data and non-print data.

In one embodiment, as illustrated in FIG. 6, substrate 32 includes a plurality of layers 33 each formed of a ceramic material. As such, substrate 32 includes circuit patterns which pierce layers 33 to form conductive paths 64. In one fabrication methodology, circuit patterns are formed in layers of unfired tape (referred to as green sheet layers) using a screen printing process. The green sheet layers are made of ceramic particles in a polymer binder. Alumina may be used for the particles, although other oxides or various glass/ceramic blends may be used. Each green sheet layer receives conductor lines and other metallization patterns as needed to form conductive paths 64. Such lines and patterns are formed with a refractory metal, such as tungsten, by screen printing on the corresponding green sheet layer. Thereafter, the green sheet layers are fired. Thus, conductive and non-conductive or insulative layers are formed in substrate 32. While substrate 32 is illustrated as including layers 33, it is, however, within the scope of the present invention for substrate 32 to be formed of a solid pressed ceramic material. As such, conductive paths are formed, for example, as thin-film metallized layers on the pressed ceramic material.

While conductive paths 64 are illustrated as terminating at first side 321 and second side 322 of substrate 32, it is, however, within the scope of the present invention for conductive paths 64 to terminate at other sides of substrate 32. In addition, one or more conductive paths 64 may branch from and/or lead to one or more other conductive paths 64. Furthermore, one or more conductive paths 64 may begin and/or end within substrate 32. Conductive paths 64 may be formed as described, for example, in U.S. Pat. No. 6,428,145, entitled "Wide-Array Inkjet Printhead Assembly with Internal Electrical Routing System" assigned to the assignee of the present invention.

It is to be understood that FIGS. 5 and 6 are simplified schematic illustrations of one embodiment of carrier 30, including substrate 32 and substructure 34. The illustrative routing of fluid passages 323 and 343 through substrate 32 and substructure 34, respectively, and conductive paths 64 through substrate 32, for example, has been simplified for clarity of the invention. Although various features of carrier 30, such as fluid passages 323 and 343 and conductive paths 64, are schematically illustrated as being straight, it is understood that design constraints could make the actual geometry more complicated for a commercial embodiment of inkjet printhead assembly 12. Fluid passages 323 and 343, for example, may have more complicated geometries to allow multiple colorants of ink to be channeled through carrier 30. In addition, conductive paths 64 may have more complicated routing geometries through substrate 32 to avoid contact with fluid passages 323 and to allow for electrical connector geometries other than the illustrated I/O pins. It is understood that such alternatives are within the scope of the present invention.

Figure 7:
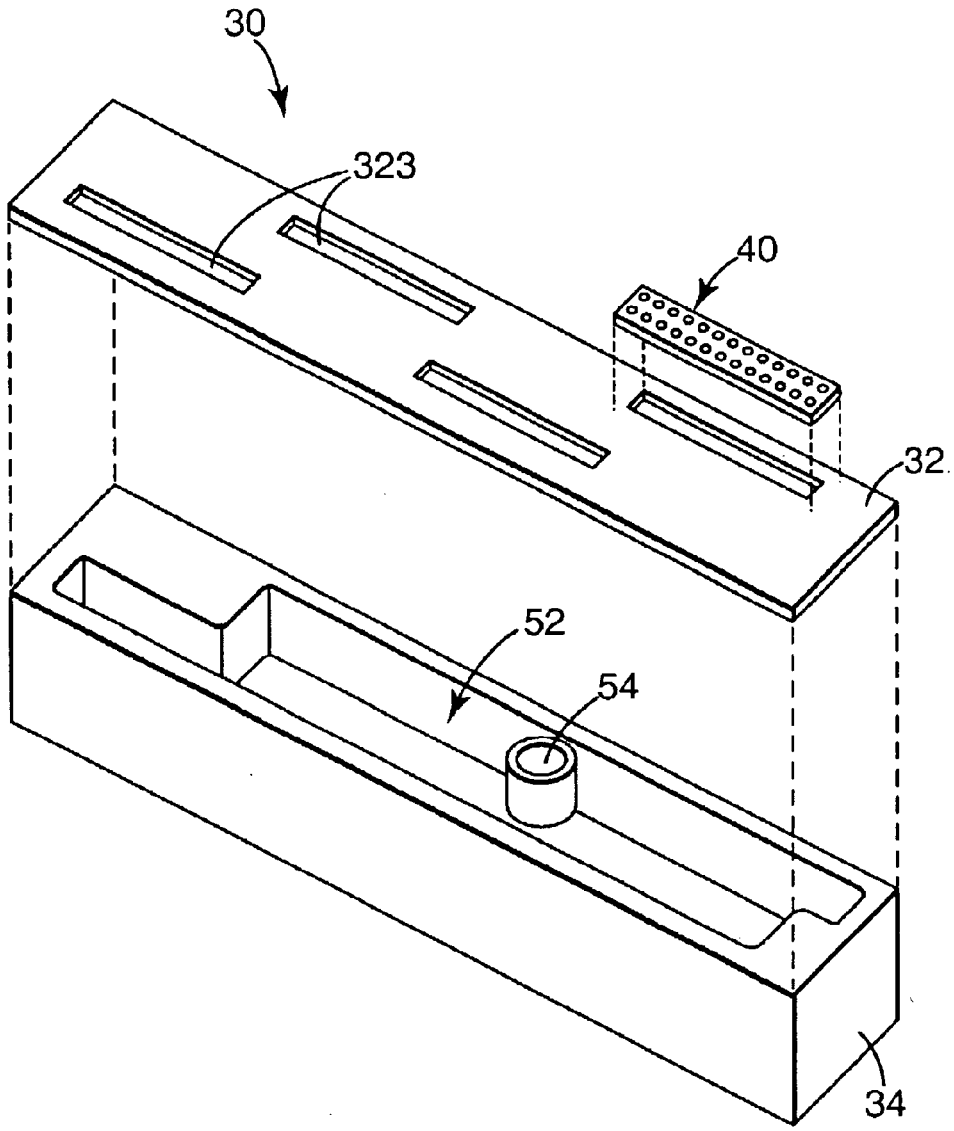
FIG. 7 is an exploded top perspective view illustrating one embodiment of a carrier for an inkjet printhead assembly.
Figure 8:
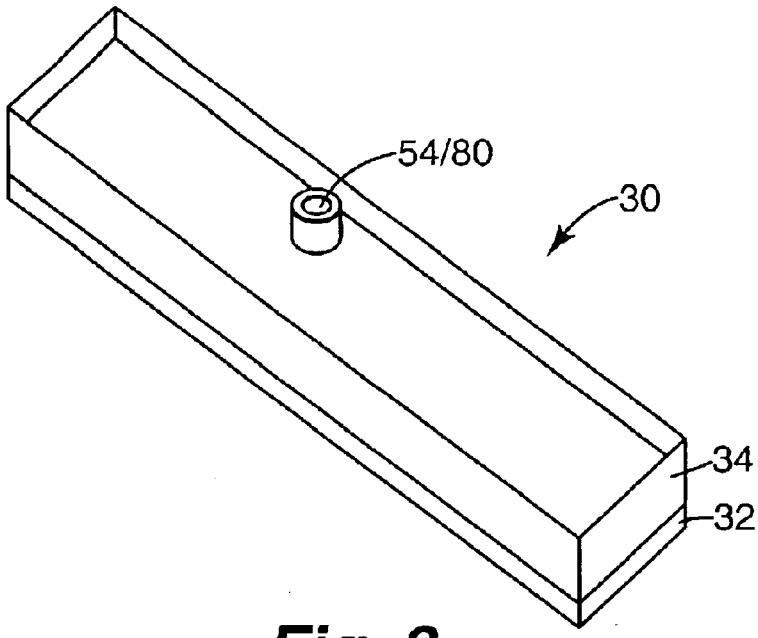
FIG. 8 is a bottom perspective view of the carrier of FIG. 7.

FIGS. 7 and 8 illustrate one embodiment of carrier 30 including substrate 32 and substructure 34. As described above, substrate 32 includes a plurality of fluid passages 323. Printhead dies 40 are mounted on substrate 32 such that each printhead die 40 communicates with one fluid passage 323. In addition, substructure 34 has fluid manifold 52 defined therein and includes fluid port 54. As such, substrate 32 forms a first side of carrier 30 and substructure 34 forms a second side of carrier 30 opposite the first side thereof. Thus, fluid passages 323 communicate with the first side of carrier 30 and fluid port 54 communicates with the second side of carrier 30. Substructure 34 supports substrate 32 such that fluid from fluid port 54 is distributed to fluid passages 323 and printhead dies 40 through fluid manifold 52.

Figure 9:
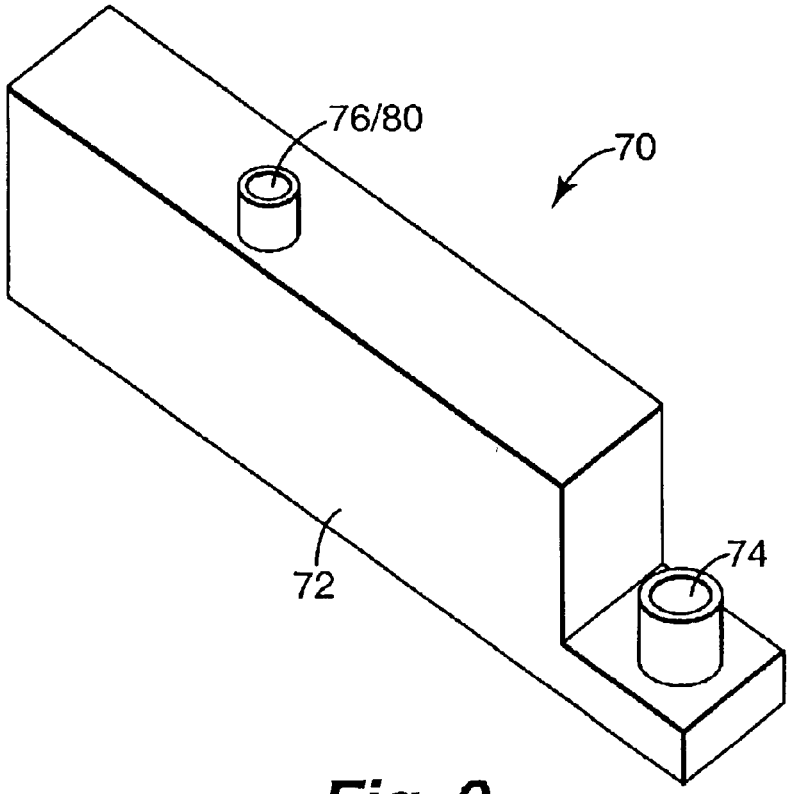
FIG. 9 is a top perspective view illustrating one embodiment of a fluid delivery assembly for an inkjet printhead assembly.

In one embodiment, as illustrated in FIG. 9, fluid delivery system 50 includes a fluid delivery assembly 70. Fluid delivery assembly 70 receives fluid from a fluid source and, in one embodiment, regulates a pressure of the fluid and filters the fluid for delivery to carrier 30. Fluid delivery assembly 70 is coupled with carrier 30 so as to communicate, in one embodiment, pressure regulated and filtered fluid with fluid manifold 52 of carrier 30.

In one embodiment, fluid delivery assembly 70 includes a housing 72, a fluid inlet 74, and a fluid outlet 76. Fluid inlet 74 communicates with a supply of fluid such as reservoir 15 of ink supply assembly 14 (FIG. 1). In one embodiment, fluid delivery assembly 70 includes a chamber which communicates with fluid inlet 74 and fluid outlet 76 such that fluid received at fluid inlet 74 is supplied to fluid outlet 76. Fluid outlet 76 communicates with fluid port 54 of carrier 30 such that fluid from fluid delivery assembly 70 is supplied to fluid manifold 52 of carrier 30.

Fluid outlet 76 of fluid delivery assembly 70 and fluid port 54 of carrier 30 form a fluid interconnect 80 which fluidically couples fluid delivery assembly 70 with fluid manifold 52 of carrier 30. As such, fluid outlet 76 constitutes a fluid coupling associated with fluid delivery assembly 70 and fluid port 54 constitutes a fluid coupling associated with carrier 30. Thus, the fluid coupling of fluid delivery assembly 70 mates with the fluid coupling of carrier 30 to deliver fluid from fluid delivery assembly 70 to carrier 30. Accordingly, a single fluid connection is established between fluid delivery assembly 70 and carrier 30 with fluid interconnect 80.

Figure 10:
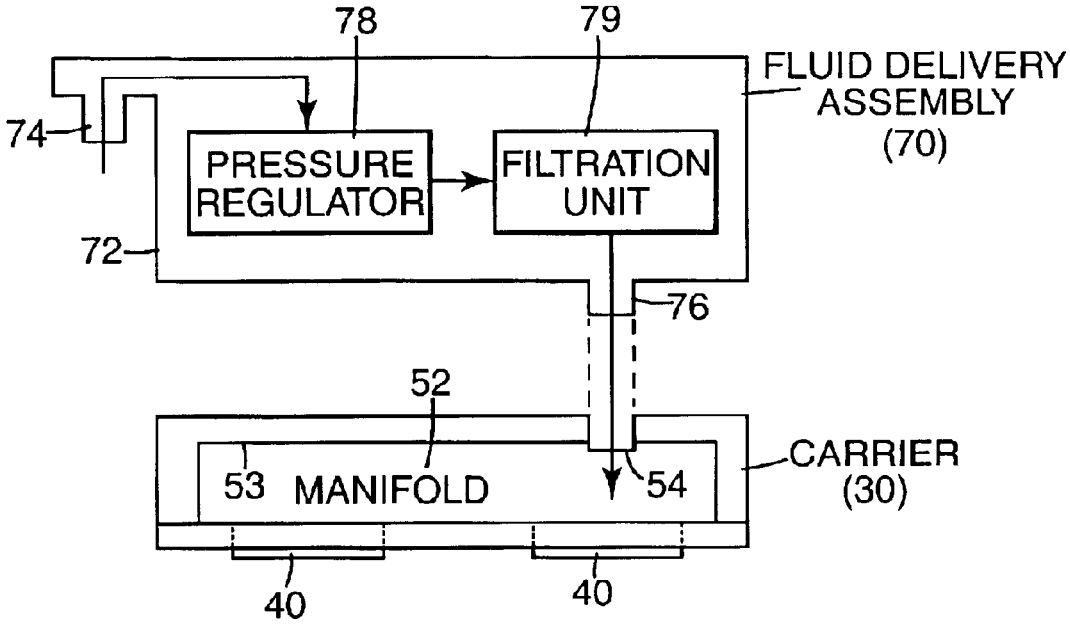
FIG. 10 is a schematic illustration of one embodiment of a fluid delivery assembly and a carrier for an inkjet printhead assembly.

In one embodiment, as illustrated schematically in FIG. 10, fluid delivery assembly 70 includes a pressure regulator 78 and a filtration unit 79. Pressure regulator 78 and filtration unit 79 are contained within housing 72. In one embodiment, pressure regulator 78 receives fluid from fluid inlet 74 and regulates a pressure of the fluid for delivery to carrier 30 and printhead dies 40. In addition, filtration unit 79 receives fluid from pressure regulator 78 and filters the fluid before delivery to carrier 30 and printhead dies 40. In one embodiment, fluid from filtration unit 79 is supplied to fluid manifold 52 of carrier 30 via fluid outlet 76 of fluid delivery assembly 70 and fluid port 54 of carrier 30.

By forming fluid delivery assembly 70 separately from carrier 30, more design freedom for both carrier 30 and fluid delivery assembly 70 is available. For example, carrier 30 and fluid delivery assembly 70 can utilize different materials and/or manufacturing techniques. In addition, carrier 30 and fluid delivery assembly 70 can be independently tested before assembly as inkjet printhead assembly 12. Thus, improved yields of inkjet printhead assembly 12 can be obtained.

Furthermore, as operation of printhead dies 40 may generate air bubbles, the affect of such air bubbles is isolated from fluid delivery assembly 70 by forming fluid delivery assembly 70 separately from carrier 30. For example, in one embodiment, fluid port 54 of carrier 30 extends or protrudes beyond a base 53 of fluid manifold 52. As such, air bubbles generated during operation of printhead dies 40 collect at base 53 of fluid manifold 52 rather than flowing through fluid port 54 and into fluid delivery assembly 70.

Figure 11:
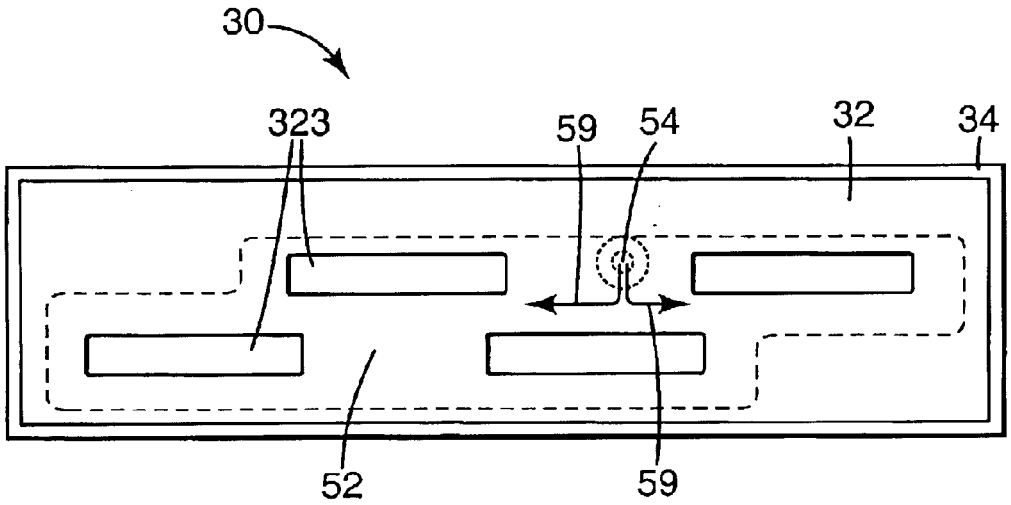
FIG. 11 is a top view illustrating one embodiment of a carrier for an inkjet printhead assembly.

In one embodiment, as illustrated in FIG. 11, fluid port 54 of carrier 30 is offset from fluid passages 323. As such, fluid port 54 distributes fluid radially and axially to fluid manifold 52 and fluid passages 323, as illustrated by arrows 59. Fluid port 54 is spaced from fluid passages 323 to provide a more balanced flow of fluid to printhead dies 40 and to avoid having air bubbles from printhead dies 40 enter fluid port 54.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A printhead assembly, comprising:

a carrier having a fluid manifold defined therein;

a plurality of printhead dies each mounted on the carrier and communicating with the fluid manifold; and a fluid delivery assembly coupled with the carrier and communicating with the fluid manifold, wherein the fluid delivery assembly includes a housing, a fluid inlet adapted to communicate with a supply of fluid, and at least one of a pressure regulator adapted to regulate a pressure of the fluid and a filtration unit adapted to filter the fluid, wherein the fluid inlet is formed in the housing, and the at least one of the pressure regulator and the filtration unit are contained within the housing.

2. The printhead assembly of claim 1, wherein the fluid delivery assembly is adapted to communicate with a supply of fluid and supply the fluid to the fluid manifold, and wherein the fluid manifold is adapted to distribute the fluid to the printhead dies.

3. The printhead assembly of claim 1, wherein the carrier includes a substrate adapted to support the printhead dies and having a plurality of fluid passages defined therein, and a substructure supporting the substrate and having the fluid manifold defined therein, wherein the fluid manifold communicates with the fluid passages.

4. The printhead assembly of claim 1, further comprising:

a fluid interconnect fluidically coupling the fluid delivery assembly with the fluid manifold of the carrier.

5. The printhead assembly of claim 4, wherein the fluid interconnect includes a first fluid coupling associated with the fluid delivery assembly and a second fluid coupling associated with the carrier, wherein the second fluid coupling is adapted to mate with the first fluid coupling.

6. The printhead assembly of claim 1, wherein the carrier includes a fluid port and has a plurality of fluid passages defined therein, wherein the fluid port and each of the fluid passages communicate with the fluid manifold, and wherein the fluid manifold is adapted to distribute fluid from the fluid port to each of the fluid passages.

7. The printhead assembly of claim 6, wherein the carrier has a first side and a second side opposite the first side, wherein each of the fluid passages communicate with the first side of the carrier and the fluid port communicates with the second side of the carrier.

8. The printhead assembly of claim 7, wherein the fluid port is offset from each of the fluid passages.

9. The printhead assembly of claim 6, wherein the fluid port is adapted to deliver fluid radially and axially to the fluid manifold.

10. The printhead assembly of claim 6, wherein the fluid manifold has a base and the fluid port protrudes beyond the base of the fluid manifold.

11. The printhead assembly of claim 1, further comprising:

an electrical interconnect associated with the carrier and electrically coupled with the printhead dies.

12. A method of forming a printhead assembly, the method comprising:

forming a fluid manifold in a carrier;

mounting a plurality of printhead dies on the carrier, including communicating each of the printhead dies with the fluid manifold; and coupling a fluid delivery assembly with the carrier, including communicating the fluid delivery assembly with the fluid manifold, wherein the fluid delivery assembly includes a housing, a fluid inlet adapted to communicate with a supply of fluid, and at least one of a pressure regulator adapted to regulate a pressure of the fluid and a filtration unit adapted to filter the fluid, wherein the fluid inlet is formed in the housing, and the at least one of the pressure regulator and the filtration unit are contained in the housing.

13. The method of claim 12, wherein the fluid delivery assembly is adapted to communicate with a supply of fluid and supply the fluid w the fluid manifold, and wherein the fluid manifold is adapted to distribute the fluid to the printhead dies.

14. The method of claim 12, wherein mounting the printhead dies on the carrier includes supporting the printhead dies on a substrate of the carrier, and wherein forming the fluid manifold in the carrier includes defining the fluid manifold in a substructure of die carrier and communicating the fluid manifold with a plurality of fluid passages of the substrate.

15. The method of claim 12, wherein communicating the fluid delivery assembly with the fluid manifold includes fluidically coupling the fluid delivery assembly with the fluid manifold.

16. The method of claim 15, wherein fluidically coupling the fluid delivery assembly with the fluid manifold includes mating a first fluid coupling associated with the fluid delivery assembly with a second fluid coupling associated with the carrier.

17. The method of claim 12, further comprising:

forming a fluid port and a plurality of fluid passages in the carrier, including communicating the fluid port and each of the fluid passages with the fluid manifold, wherein the fluid port is adapted to distribute fluid from the fluid port to each of the fluid passages.

18. The method of claim 17, wherein the carrier has a first side and a second side opposite the first side, wherein forming the fluid port and the fluid passages in the carrier includes forming the fluid passages in the first side of the carrier and forming the fluid port in the second side of the carrier.

19. The method of claim 18, wherein forming the fluid port and the fluid passages in the carrier includes offsetting the fluid port from each of the fluid passages.

20. The method of claim 17, wherein the fluid port is adapted to deliver fluid radially and axially to the fluid manifold.

21. The method of claim 17, wherein forming the fluid port in the carrier includes extending the fluid port beyond a base of the fluid manifold.

22. The method of claim 12, further comprising:

electrically coupling the printhead dies with an electrical interconnect associated with the carrier.

23. A method claim of supplying fluid to a plurality of printhead dies, the method comprising:

mounting the printhead dies on a carrier;

communicating a fluid manifold of the carrier with each of the printhead dies;

communicating a fluid delivery assembly with a supply of the fluid and the fluid manifold, wherein the fluid delivery assembly includes a housing, a fluid inlet formed in the housing and adapted to communicate with the supply of fluid, and at least one of a pressure regulator and a filtration unit contained within the housing; and distributing the fluid to the printhead dies through the fluid delivery assembly and the fluid manifold, including at least one of regulating a pressure of the fluid with the pressure regulator and filtering the fluid with the filtration unit.

24. The method of claim 23, wherein communicating the fluid manifold with the printhead dies includes communicating each of a plurality of fluid passages of the carrier with the fluid manifold and a respective one of the printhead dies, and wherein communicating the fluid delivery assembly with the fluid manifold includes communicating a fluid port of the carrier with the fluid manifold and the fluid delivery assembly.

25. The method of claim 24, wherein the carrier has a first side and a second side opposite the first side, wherein communicating the fluid passages with the fluid manifold includes communicating the fluid passages with the first side of the carrier, and wherein communicating the fluid port with the fluid manifold includes communicating the fluid port with the second side of the carrier.

26. The method of claim 25, wherein communicating the fluid passages with the first side of the carrier and communicating the fluid port with the second side of the carrier includes offsetting the fluid port from the fluid passages.

27. The method of claim 24, wherein distributing the fluid to the printhead dies includes delivering the fluid radially and axially from the fluid port to the fluid manifold.

28. The method of claim 24, wherein distributing the fluid to the printhead dies includes distributing the fluid from the fluid port to each of the fluid passages via the fluid manifold.

29. The method of claim 24, wherein communicating the fluid port with the fluid manifold includes extending the fluid port beyond a base of the fluid manifold.

30. The method of claim 23, wherein communicating the fluid delivery assembly with the fluid manifold includes coupling the fluid delivery assembly with the carrier.

* * * * *

UNITED STATES PATENT AND TRADEMARK OFFICE

CERTIFICATE OF CORRECTION

PATENT NO. : 6,942,316 B2
APPLICATION NO. : 10/283468
DATED : September 13, 2005
INVENTOR(S) : Scheffelin et al.

It is certified that error appears in the above-identified patent and that said Letters Patent is hereby corrected as shown below:

In the Claims

Col. 9 (line 41), delete “die” and insert therefor --the--.

Signed and Sealed this

Twenty-sixth Day of December, 2006

JON W. DUDAS
*Director of the United States Patent and Trademark Office*